United States Patent [19]

Grady, II

[11] 4,442,995

[45] Apr. 17, 1984

[54] MACHINE FOR CONCRETE MOLDING

[76] Inventor: Clyde C. Grady, II, 4914 Deerwood Cir., Baytown, Tex. 77521

[21] Appl. No.: 143,775

[22] Filed: Apr. 25, 1980

Related U.S. Application Data

[63] Continuation-in-part of Ser. No. 3,723, Jan. 15, 1979, Pat. No. 4,253,636.

[51] Int. Cl.[3] ..... B28B 7/06; B28B 1/08

[52] U.S. Cl. ..... 249/139; 249/161; 249/163; 249/164; 249/167; 249/170; 249/219 R; 425/451.9; 425/456

[58] Field of Search ..... 249/161, 162, 163, 164, 249/167, 137, 139, 152, 155, 168, 169, 170, 142, 219 R; 425/182, 188, 450.1, 451, 453, 454, 456, 450.9, 451.9

[56] References Cited

U.S. PATENT DOCUMENTS

| | | | |
|---|---|---|---|
| 786,272 | 4/1905 | Dow | 249/169 |
| 804,240 | 11/1905 | Libby | 249/167 |
| 856,383 | 6/1907 | Armbruster | 249/169 |
| 1,532,924 | 4/1925 | Nelson | 249/163 |
| 3,132,403 | 5/1964 | Richards et al. | 249/170 |
| 3,934,808 | 1/1976 | Aizawa | 249/152 |

*Primary Examiner*—Willard E. Hoag

[57] ABSTRACT

Apparatus for molding concrete wherein a mold has vertical side members which are mounted for rotation about internal axes substantially parallel to sides of said members.

4 Claims, 10 Drawing Figures

MACHINE FOR CONCRETE MOLDING

This application is a continuation in part of the application Ser. No. 003,723 filed Jan. 15, 1979 for a 'Concrete Molding Machine' which has since issued as U.S. Pat. No. 4,253,636, issued Mar. 3, 1981.

The present application discloses a molding machine having substantial improvements over the prior art and the art disclosed in Ser. No. 003,723 in the molding of concrete or other plastic materials which subsequently harden to form solid structural components or members. The invention described herein provides an improved means of the molding of concrete as on an assembly line in a step-wise cycle, on, over, or adjacent to a conveyor belt or other means of conveying the mold parts and molded articles from one point to another. A typical step-wise cycle is described for the use of the machine as well as auxilliary parts for the efficient operation of the machine.

Further features of the invention will appear below.

Reference is to be had to the accompanying drawings, forming a part of this specification, in which similar characters of reference indicate corresponding parts in all the views.

DETAILED DESCRIPTION OF DRAWINGS

Figures 2, 3:
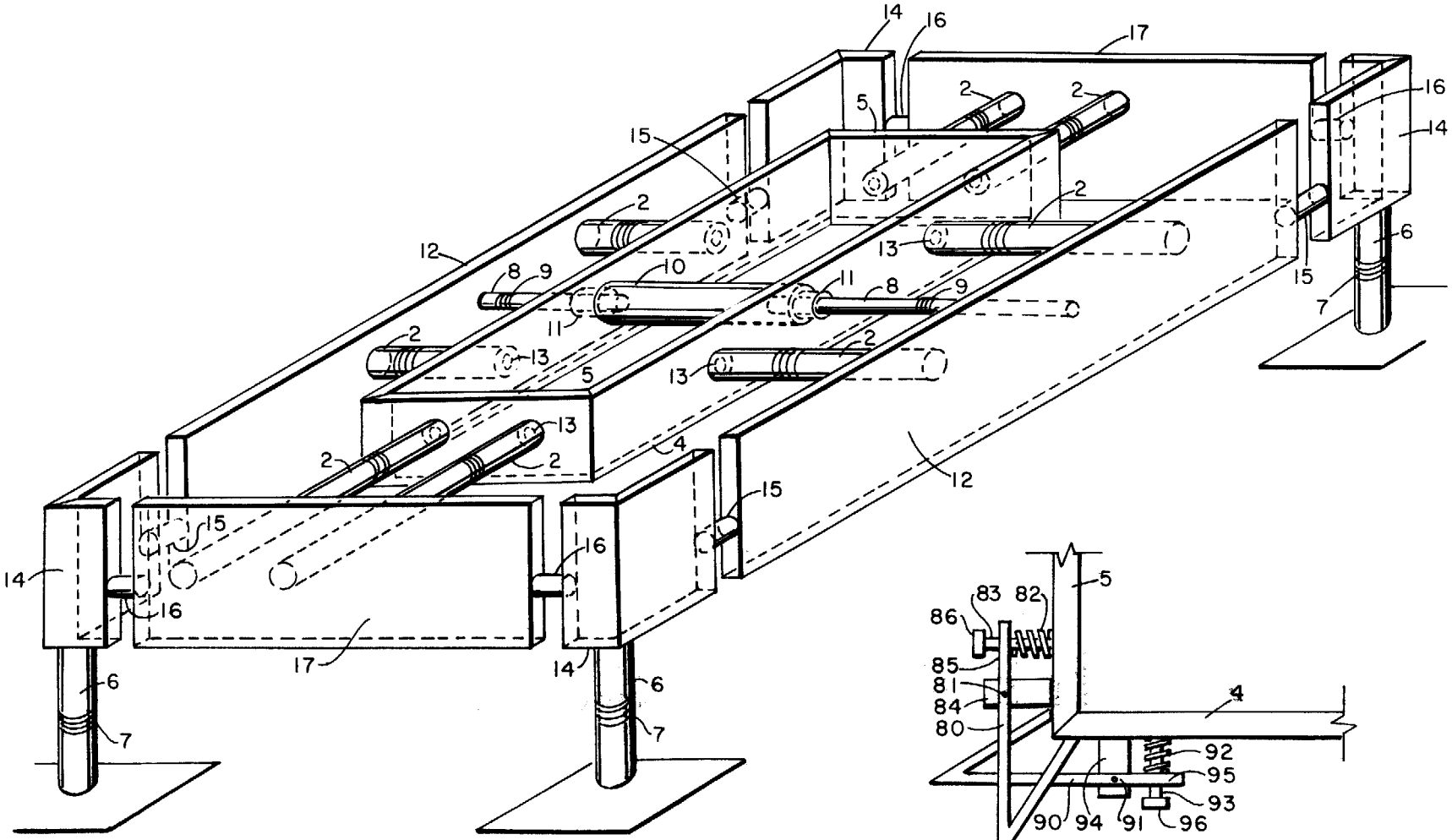
FIG. 2 shows in perspective the instant invention.
FIG. 3 is a plan view of a mold corner and positioning means therefor.

FIG. 2 presents a drawing of the present invention in perspective, wherein an outer frame is composed of supporting shafts 15, longer sides 12, corner elements 14, shorter sides 11, and supporting shafts 16. Shorter sides 11 are so constructed as to be each capable of rotation about the common axis of the supporting shafts 16, which connect a particular shorter side 11 to its adjacent corner elements 14. Longer sides 12 are so constructed as to be capable of rotation about the common axis of the supporting shafts 15 which connect a particular longer side 12 to its adjacent corner elements 14. FIG. 3 is a detail of FIG. 2, of the intersection of sides 4 and 5 in overhead view, wherein there is shown a means of holding sides 4 and 5 in abutment with one another after the retraction of the horizontal arms 2, which originally placed sides 4 and 5 in abutment.

Shown in FIG. 3 are spring positioning pin 83 and support block 84 which are welded or otherwise attached to mold side 5. also shown in FIG. 3 are positioning pin 93 and support block 94 which are similarly welded or otherwise attached to mold side 4. Through support blocks 84 and 94 are seen to pass pivot pins 81 and 91, respectively, wherein said pivot pins are secured so that hooks 80 and 90 may pivot about pivot pins 81 and 91, respectively. Spring positioning pins 83 and 93 pass through the centers of springs 82 and 92 respectively and through holes 85 and 95 respectively, so that springs 82 and 92 are held in partial compression between sides 5 and 4 and hooks 80 and 90. Stops 86 and 96 in turn limit the travel of hooks 80 and 90 respectively. Compression of springs 82 and 92 through the rotation of hooks 80 and 90, respectively, about pivot pins 81 and 91, respectively, is made for the disengagement of side 4 from side 5.

Figure 1:
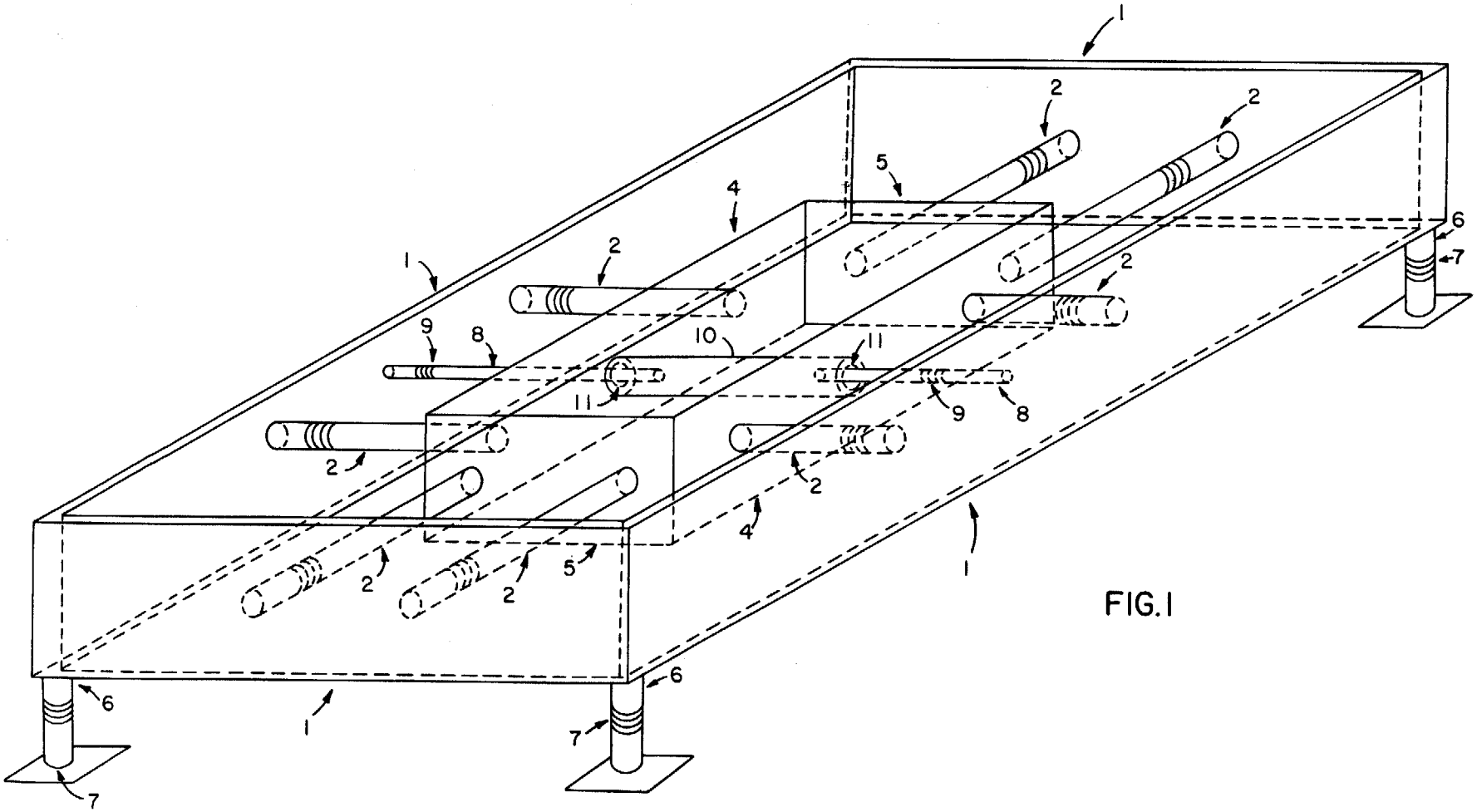
FIG. 1 shows in perspective a prior invention of which the instant invention is an improvement.

FIGS. 4A, 4B, 4C and 4D are used to illustrate four different points in the continuous operation of the machine of FIG. 1 to produce molded articles of various sizes, wherein said articles may be made with the aid of mold sides of various dimensions.

Figure 4A:
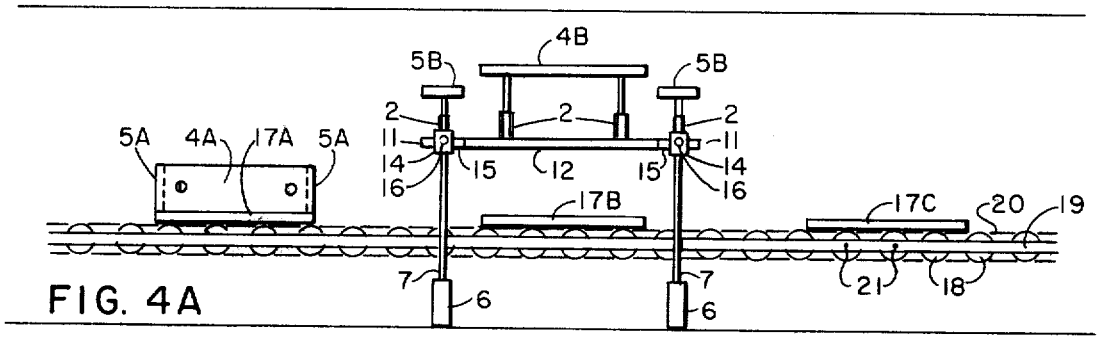
FIGS. 4A, 4B, 4C and 4D and FIGS. 5A, 5B, and 5C are schematic drawings illustrating phases of operation of the invention.

FIG. 4A shows expansion arms 7 in the enxteded position. Likewise, expansion arms 3 have been extended upward so as to come into contact with two mold sides 5B, a mold side 4B, and an additional mold side 4B not shown in FIG. 4A, wherein view of the second mold side 4B is totally blocked by the mold side 4B shown. In order to effect the orientation of expansion arms 3 in the vertical position, outer frame sides 11 and 12 were made to rotate about supporting shafts 16 and 15, respectively, so that outer frame sides 11 and 12 assume a horizontal position and arms 3 were extended upward from frame sides 11 and 12. Thus extended upward, arms 3 were made to contact mold sides 5B in the case of arms 3 attached to sides 11 and arms 3 attached to sides 12 were made to contact mold sides 4B wherein sides 4B and 5B were suspended in the orientation and position shown before attachment as by an overhead conveyor system or systems not shown. Arms 3, having been made to contact mold sides 5B, were made secure to mold sides 5B as through the energizing of electromagnets secured in the ends of arms 3. Also shown in FIG. 4A are mold bottom plates 17B and 17C which are supported by and transported on the rollers 18 supported between horizontal beams 19 and 20. Through controlled rotation of rollers 18 around shafts 21, which pass through the major axis of the right circular cylinder which forms the exterior surface of rollers 18, mold bottom plates, such as 17B and 17C, undergo controlled movement from a position to the right of the area delimited by the four expandable arms 7, as depicted by the position of mold bottom plate 17C, to a position within the area delimited by the four expandable arms 7.

Said position within the area delimited by the four expandable arms 7, is as depicted by the position of mold bottom plate 17B in FIG. 3A.

Also shown in FIG. 4A is the assembled filled mold which was assembled from two mold sides 5A, two mold sides 4A, and mold bottom plate 17A; wherein said assembled, filled mold has been moved to its position depicted outside of and to the left of the area delimited by the four expandable arms 7 by an action of the roller 18 similar to that which allows movement of mold bottom plates within the area delimited by the expandable arms 7.

Figure 4B:
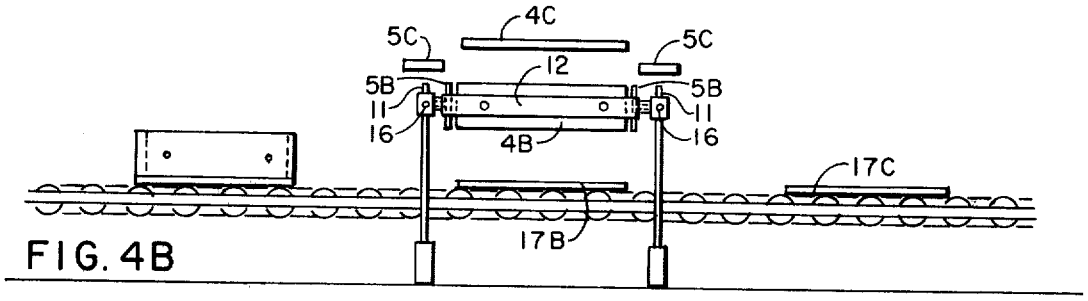

FIG. 4B depicts the concrete molding machine following retraction of the expandable arms 3 from the position of FIG. 3A with the subsequent rotation inward of mold sides 4B and 5B about supporting shafts 15 and 16 respectively, whereby mold sides 4B and 5B attain a substantially vertical position.

It can also be seen in FIG. 4B that mold side 5C and 4C have been placed in the relative position over the concrete molding machine formerly occupied by sides 4B and 5B as through the action of an overhead conveying system, not shown.

Figure 4C:
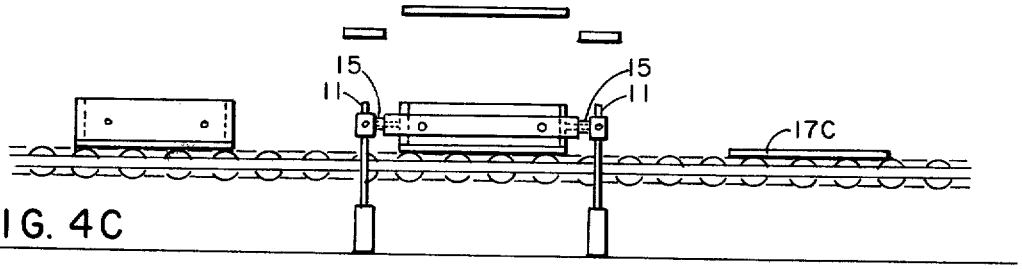

FIG. 4C depicts the concrete molding machine following expansion of expandable arms 3 such that sides 4B and 5B come together to form the enclosed area of a mold in the manner shown in FIG. 2 with the subsequent locking in spatial arrangement each to each, as through the action of latches as shown in FIG. 3 or by other means. Said latching system depicted in FIG. 3 or other means of attachment is made to act at each intersection of a side 4B with a side 5B. Simultaneously with the expansion of expandable arms 3, expandable arms 7 were retracted from the extended position shown in FIG. 4B to attain the position shown in FIG. 4C whereby the mold sides 5B and 4B are placed in contact with the mold bottom 17B. The latching mechanism shown in FIG. 3 may be used to attach each side 5B and side 4B to mold bottom 17B, wherein each side 4B and each side 5B would occupy the relative position of side 5 as labeled in FIG. 3 and mold bottom 17B would occupy the relative position of side 4 as labeled in FIG. 3. Alternatively, other means of attachment may be used to securely fasten sides 4B and 5B to mold bottom 17B.

In the position shown in FIG. 4C the mold assembled by the molding machine is filled with uncured concrete and expandable arms 7 may be alternately expanded and contracted through extremely short distances such that a vibrating action is introduced which works to release unwanted air entrapped within the concrete.

Figure 4D:
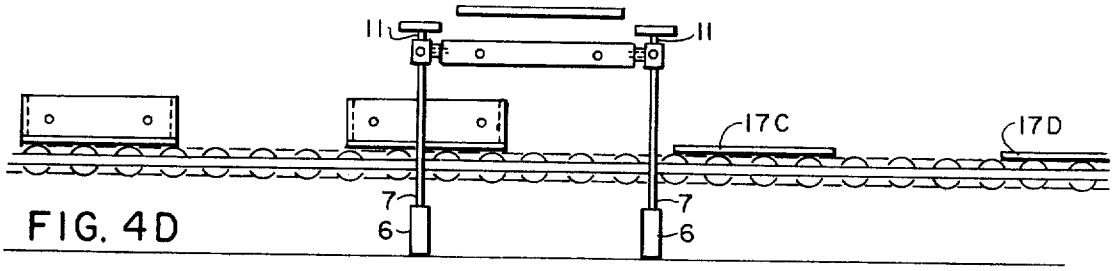

FIG. 4D depicts the concrete molding machine wherein, in sequence, expandable arms 3 have been disengaged from sides 4B and 5B as through the deactivation of electromagnets 13, then expandable arms 7 are expanded. The outer frame of the concrete molding machine is thereby no longer an obstruction to the removal of the filled concrete mold, composed of sides 4B and 5B and mold bottom 17B, to the left by the controlled revolution of rollers 18 around shafts 21 to the position shown in FIG. 4D. Said revolution of rollers 18 around shafts 21 also is seen in FIG. 4D to have advanced mold bottom 17C to the left and brought into the field of the drawing 3D, the additional mold bottom 17D.

The next sequential step in the cycle of operation of the concrete molding machine would be represented again by the relative positioning revealed in FIG. 4A, wherein the positions of items 5B, 4B, 17B and 17C as depicted in FIG. 4A would be occupied by items 5C, 4C, 17C and 17D respectively. In the said next sequential step the position of the filled mold, composed of items 5A, 4A, and 17A in FIG. 4A, would be occupied by the filled mold composed of items 5B, 4B, and 17B.

It is within the teaching of this invention that mold sides 5C and 4C need not have the same dimensions as mold sides 5B and 4B. Neither is it necessary in consequence that mold bottom 17C be dimensioned identically to mold bottom 17B. In this way, molded concrete articles of different dimensions can be manufactured on the concrete molding machine with no interruption.

It is also within the teaching of this invention that subsequent to the filling of the assembled mold with uncured concrete, as depicted in FIG. 4C; wherein said uncured concrete is of the type known in the art as zero-slump concrete, or a facsimile thereof, that sides 4B and 5B may remain attached to the expandable arms 3 such that retraction of arms 3 from their extended position frees mold sides 4B and 5B from the molded article. Wherein said molded article does not require the support of mold sides 4B and 5B to retain its molded shape until a more advanced stage of the curing of the concrete by virtue of the nature of zero-slump concrete. Even though sides 4B and 5B would remain with and attached to arms 3, expansion of expandable arms 7 would allow passage of the molded article from within the confines of the concrete molding machine through the rotation of rollers 18 around shafts 21, whereby the molded article would be transported from within said confines on the mold bottom 17B.

FIG. 5 shows that it is also within the teaching of this invention that means, such as hydraulic cylinders or screw threads, may be provided to raise and lower the mold bottom plate 17 to and from an elevated position occupied by the mold sides and outer frame in the operating cycle of the machine. This could represent a savings in the power required for the operation of the machine and hence could represent a savings in the energy costs of the operation of the machine.

Figure 5A:
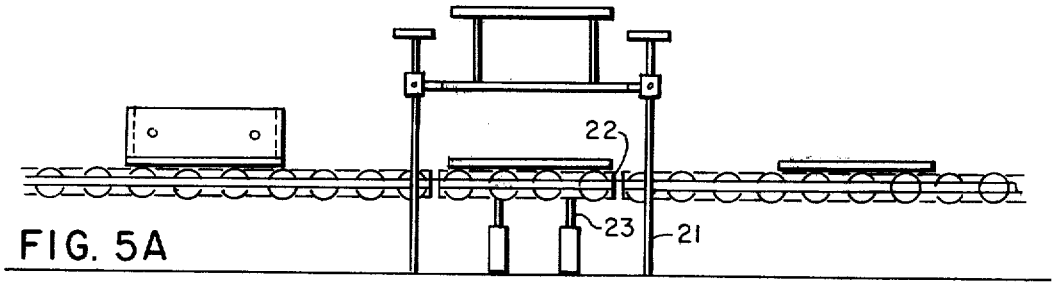
Figure 5B:
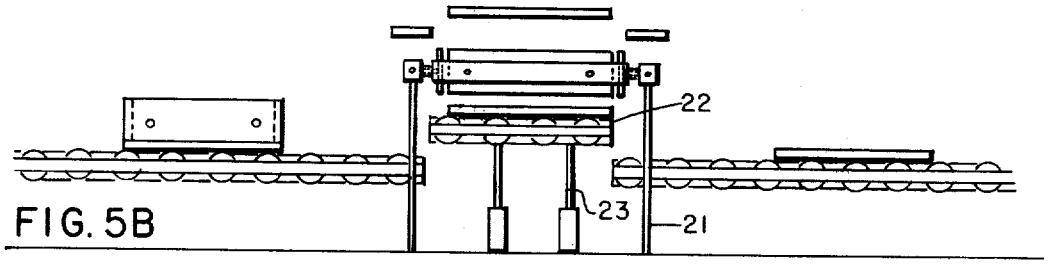
Figure 5C:
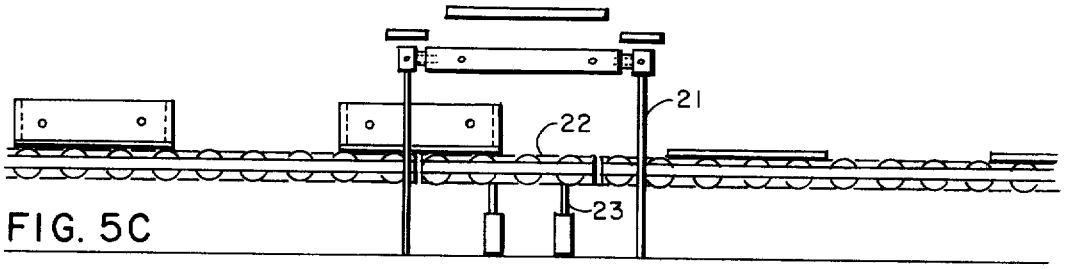

Within FIG. 5, FIG. 5A shows that the expandable arms 7 and pedestals 6 of FIG. 4 have been replaced by single piece pedestals 21 which may be of fixed length. In FIG. 5 a section of the conveyor formed by rollers 18 and horizontal beams 19 and 20 has been made separate as platform 22. The platform 22 is raised to an elevated position by the expansion of cylinder 23 to contact the mold sides 4 and 5 in the process of the assembly of the mold as shown in FIG. 5B. FIG. 5C shows that following the assembly and filling of the mold the cylinder 23 may be contracted to lower the platform 22 and the filled mold, comprised of mold sides 4 and 5 and mold bottom 17, may gain egress from the space enclosed by the pedestals 21.

While a preferred form of the invention has been illustrated and described along with its use, further modification, improvements and further uses will occur to those skilled in the art who come to understand the precepts hereof and practice my invention. Therefore, it is not desired to be limited in the scope, effect and use of the patent to the specific form and use herein exemplified and described to illustrate the invention.

What is claimed is:

1. An apparatus for molding concrete comprising a substantially rectangular frame comprised of four corner members and four side members, said apparatus having a side member disposed between each two of said corner members, each of said side members being rotatable about supporting shafts between each said side member and each said corner member, said frame having an open bottom, each of said side members being substantially perpendicular to and attached to expandable members, where each said expandable member is disposed between and attached at either end of its extremity to a said side member and a mold side, respectively, where expansion and contraction of each said expandable member moves the mold side to which it is attached in a direction substantially perpendicular to the axis of rotation of the side member to which it is also attached.

2. The apparatus of claim 1 where the aforesaid frame is adjustable in height.

3. The apparatus of claim 1 where the aforesaid mold sides are releasably attached to their respective expandable members.

4. The apparatus of claim 1 where a means is provided for the attachement, one to another, of the aforesaid mold sides such that following the release of the mold sides from the expandable member, the aforesaid mold sides remain in the spatial relationship defining an assembled mold.

* * * * *